US010039433B2

(12) United States Patent
Steiner et al.

(10) Patent No.: US 10,039,433 B2
(45) Date of Patent: Aug. 7, 2018

(54) DISHWASHER SPRAY ARM

(71) Applicant: ELECTROLUX APPLIANCES AKTIEBOLAG, Stockholm (SE)

(72) Inventors: Winfried Steiner, Stockholm (SE); Finn Svensson, Stockholm (SE); Maciej Zienkiewicz, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 158 days.

(21) Appl. No.: 14/897,543

(22) PCT Filed: Jul. 3, 2013

(86) PCT No.: PCT/EP2013/064018

§ 371 (c)(1),
(2) Date: Dec. 10, 2015

(87) PCT Pub. No.: WO2015/000512

PCT Pub. Date: Jan. 8, 2015

(65) Prior Publication Data

US 2016/0183762 A1 Jun. 30, 2016

(51) Int. Cl.
*A47L 15/42* (2006.01)
*A47L 15/23* (2006.01)

(52) U.S. Cl.
CPC ..... *A47L 15/4202* (2013.01); *A47L 15/23* (2013.01)

(58) Field of Classification Search
CPC ..... A47L 15/4202
See application file for complete search history.

(56) References Cited

U.S. PATENT DOCUMENTS

| | | | | |
|---|---|---|---|---|
| 4,210,285 | A | 7/1980 | Dicken, Jr. et al. | |
| 4,509,687 | A | 4/1985 | Cushing et al. | |
| 5,598,976 | A | 2/1997 | Jang et al. | |
| 7,810,512 | B2 | 10/2010 | Pyo et al. | |
| 8,020,568 | B2 | 9/2011 | Pyo et al. | |
| 2008/0135067 | A1* | 6/2008 | Mersch | A47L 15/4202 134/25.2 |
| 2008/0271759 | A1 | 11/2008 | Burrows et al. | |
| 2011/0203619 | A1 | 8/2011 | Kara et al. | |

(Continued)

FOREIGN PATENT DOCUMENTS

| | | |
|---|---|---|
| CN | 1289270 | 3/2001 |
| CN | 101677743 | 3/2010 |
| DE | 19736919 | 3/1999 |

(Continued)

OTHER PUBLICATIONS

International Search Report and Written Opinion from International Application No. PCT/EP2013/064018, dated Jul. 3, 2013.

(Continued)

*Primary Examiner* — Jason Ko
(74) *Attorney, Agent, or Firm* — Alston & Bird LLP

(57) ABSTRACT

A spray arm for a dishwasher is described in which the spray arm may include an inlet for a cleaning liquid, at least one spray nozzle and a feed channel for feeding the cleaning liquid from the inlet to the spray nozzle. In order to prevent larger dirt particles from reaching any of the spray nozzles, a filter may be provided within the feed channel between the inlet and the spray nozzle.

21 Claims, 2 Drawing Sheets

(56) References Cited

U.S. PATENT DOCUMENTS

2012/0325277 A1 12/2012 Mitchell et al.

FOREIGN PATENT DOCUMENTS

| | | |
|---|---|---|
| DE | 202004013786 | 11/2004 |
| DE | 102010043019 | 5/2012 |
| DE | 102011088494 | 6/2013 |
| DE | 102012103445 | 10/2013 |
| EP | 988824 | 3/2000 |
| GB | 864979 | 4/1961 |
| JP | H11244214 | 9/1999 |
| WO | WO 00/33965 | 6/2000 |

OTHER PUBLICATIONS

Office Action for Chinese Application No. 201380076668.8 dated Mar. 28, 2018, 6 pages.

* cited by examiner

DISHWASHER SPRAY ARM

CROSS-REFERENCE TO RELATED APPLICATIONS

This application is a national stage application filed under 35 U.S.C. § 371 of International Application No. PCT/EP2013/064018 filed Jul. 3, 2013, which application is hereby incorporated by reference in its entirety.

FIELD OF THE INVENTION

The present invention relates to a spray arm for a dishwasher.

BACKGROUND

Spray arms in dishwashers comprise a hollow element, typically an elongated hollow element made of sheet metal or plastic, having a plurality of spray nozzles, through which a cleaning liquid can be sprayed against articles to be cleaned.

During a washing cycle, the cleaning liquid usually is circulated continuously through the washing compartment. Thus, the cleaning liquid, such as water to which a detergent has been added, is sprayed by means of rotating spray arms onto articles that are located within the washing compartment. Upon having dripped from the wetted articles to the floor of the washing compartment, the cleaning liquid is collected in a sump of the dishwasher to again be fed by means of a circulation pump to the spray arms.

Although the cleaning liquid on its way to the circulation pump has to pass several filters, such as a coarse filter located around the drain of the sump, and a fine filter that covers a portion of the floor of the washing compartment, from time to time larger dirt particles contained in the cleaning liquid manage to bypass the filters and thus are fed to the spray arms. Given that the nozzles of the spray arm have a small opening diameter, there is a high likelihood that such dirt particles get stuck in one of the nozzles and thus block the flow through the nozzle.

A blockage of the nozzles not only may lead to a poor cleaning result in the specific area of the washing compartment to be covered by the blocked nozzle, but also can deteriorate the overall washing result in case that the blocked nozzle is adapted to provide for a momentum to set the spray arm into rotation, such as by ejecting a water jet at an angle to the axis of rotation of the spray arm.

In order to overcome the above problems, the prior art has made several attempts to prevent larger dirt particles from reaching the spray arm, such as by providing for improved filters in the sump of the washing compartment.

Furthermore, in U.S. Pat. No. 4,210,285 it was suggested to specifically design the channels within the spray so as to guide long slender objects, such as toothpicks, in such a manner towards the spray nozzles, that they do not get stuck within the flow channel but are ejected through the nozzle.

While the earlier attempts may have alleviated the above problems, they were unable to overcome these problems. Thus there still exists a need in the art for improvements so as to avoid larger dirt particles, and in particular dirt particles having a size so that they cannot pass the spray nozzles, from reaching the spray nozzles.

SUMMARY OF VARIOUS EMBODIMENTS

The present invention aims at overcoming the above problem by providing for a spray arm for a dishwasher, the spray arm comprising an inlet for a cleaning liquid, at least one spray nozzle and a feed channel for feeding the cleaning liquid from the inlet to the spray nozzle, wherein in accordance with the present invention filter means are located within the feed channel between the inlet and the spray nozzle. By providing for filter means located within the feed channel, that is within the spray arm as such, larger dirt particles can be effectively prevented from reaching any of the spray nozzles even after the dirt particles have passed the filters provided in the sump of the washing compartment.

Considering that spray arms in modern dishwashers typically are flat elongate members in which the feed channel has a width of several centimeters, whereas the spray nozzles have an opening size in the millimeter range, by providing for a filter means within the feed channel between the inlet and the spray nozzle, any dirt particles that have reached the spray arm can be caught and retained in a portion of the spray arm where they do not cause any notable deterioration of the flow through the feed channel and thus through the spray nozzles.

Preferred embodiments of the present invention are defined in the dependent claims.

In embodiments the spray arm comprises a plurality of spray nozzles, wherein a filter means is provided in proximity of at least one of the spray nozzles. In such embodiments filter means thus can be provided individually for any spray nozzle to be protected. In embodiments where the spray arm comprises a plurality of spray nozzles, each spray nozzle can be provided with an individual filter means.

In alternative embodiments the spray arm can comprise a filter means that spans substantially the entire cross-section of the feed channel. That is, rather than providing filter means individually for any or each of the spray nozzles, such filter means provide for a filtering of the flow through the feed channel, or a portion thereof, irrespective of how many spray nozzles are fed by such feed channel. In embodiments having such central filter means in the feed channel, the filter means preferably is located remote from the spray nozzles, so as to minimize the impact of the filter means and any debris collected therein on the flow to the spray nozzles.

In spray arms that are fed by a centrally located inlet and wherein the spray thus comprises more than one feed channel, such as two feed channels in elongate straight or wave-shaped spray arms, or three or more feed channels in star shaped spray arms, separate filter means can be provided in each of the feed channels.

Preferably, the filter means are located at an angle to the longitudinal direction of the feed channel, so that any dirt particles that are retained by the filter are shifted laterally so as to keep the central portion of the flow channel unobstructed.

In embodiments in which the spray arm is a substantially flat elongate member, such angled filter means can be oriented substantially vertically, so that any dirt particles that are retained by the filter are moved towards the side walls of the flow channel.

In order to keep the central portion of the flow channel unobstructed, the filter means further can comprise two lateral side portions that are located at angles to the longitudinal direction of the feed channel, and a central portion protruding towards the upstream side of the filter means. In such embodiments, at least the central portion of the filter means thus can be substantially V-shaped or convex.

The filter means can comprise any kind of filter that is effective to prevent larger dirt particles from reaching the nozzle, and thus can comprise a grate, sieve or screen.

While smaller dirt particles can be ejected through the nozzles, the filter means preferably comprises a plurality of flow orifices the opening size of which corresponds to that of the at least one spray nozzle or is slightly smaller.

Although as noted above the filter means provides for a much larger flow area than the spray nozzle, and hence, also when dirt particles are kept by the filter means, the overall flow through the filter means still will be sufficient to provide for adequate flow to the spray nozzles, the filter means can comprises a plurality of flow orifices having a flow-promoting shape, so as to further improve the flow characteristics through the filter means.

The spray arm can be produced in a particularly cost-effective manner if the spray arm is a molded plastic part, and particularly, if the filter means is integrally formed with the spray arm. In such latter embodiments, all that is required for producing the filter means is to correspondingly adapt the forming tools used for molding the spray arms, so that the filter means is formed together with forming the spray arm, without additional steps being required for providing for the filter means.

In such latter embodiments, the spray arm can comprise a substantially flat lower member and a substantially flat upper member connected to the lower member so as to form the feed channel, wherein the filter means comprises a plurality of posts protruding from the lower member and/or the upper member. Such posts preferably have a length such that when connecting the lower and upper members, the posts form a grate which substantially spans the entire height of the feed channel.

In order to facilitate the cleaning of the filter means, in embodiments wherein the spray arm comprises substantially flat lower and upper members, the lower member can be connected to the upper member in an at least partially releasable manner. Thus, the lower and upper members can be connected such that the two members can be completely separated from each other (fully releasable), or such that only feed channel can be opened but yet the two members are connected to each other, such as providing for a hinge, particularly a film hinge along one of the sides of the lower and upper member (partially releasable).

Whereas providing for an integral filter means provides for the best results in terms of manufacturing costs, the advantages of the present invention also can be achieved by providing for a filter means which comprises a filter insert that is mounted at the inlet and protrudes into the flow channel, such as a sieve element that is inserted via the inlet of the spray arm.

BRIEF DESCRIPTION OF THE SEVERAL VIEWS OF THE DRAWINGS

Embodiments of the present invention will be explained in further detail by reference to the drawings in which.

DETAILED DESCRIPTION

Figure 1:
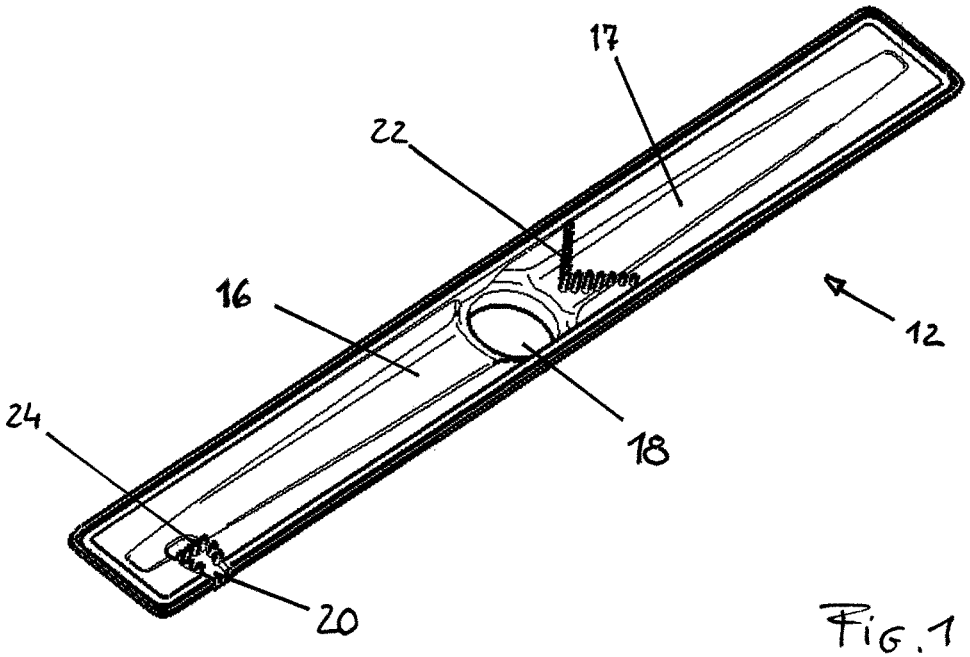
FIG. 1 is a schematic perspective view of a spray arm made in accordance with the teachings of the present invention.

In FIG. 1 there is illustrated the lower member of a spray arm made in accordance with the present invention. The spray arm 10 (see also FIG. 3) is a molded plastic part which comprises a substantially flat lower member 12 and a correspondingly shaped substantially flat upper member 14. When assembled, lower member 12 and upper member 14 form a first and a second feed channel 16, 17 via which water can be fed from an inlet 18 to a plurality of spray nozzles provided in the lower and/or the upper members 12, 14.

In the embodiment shown in FIG. 1, in which the spray arm 10 is designed for use as a lower spray arm that is provided at the floor of a dishwasher washing compartment so as to eject a plurality of water jets in an upward direction, the upper member 14 is provided with a plurality of spray nozzles that are fed by the feed channels 16, 17. While one or more of such spray nozzles can be designed to eject a water jet at an angle to the axis of rotation of the spray arm so as to provide for a momentum to cause rotation of the spray arm, the spray arm additionally or alternatively can be provided with one or more nozzles that specifically are designed as a driving nozzle. Thus, in the embodiment shown in FIG. 1, spray arm 10 is provided with a nozzle 20 which is formed by assembly of the lower member 12 and the upper member 14, wherein nozzle 20 which provides for a lateral outlet is located near one of the ends of the spray arm. By ejecting water through the driving nozzle 20 thus formed, a momentum is applied onto spray arm 10 which in the embodiment shown in FIG. 1 would set the spray arm into rotation in the clockwise direction.

Figure 2:
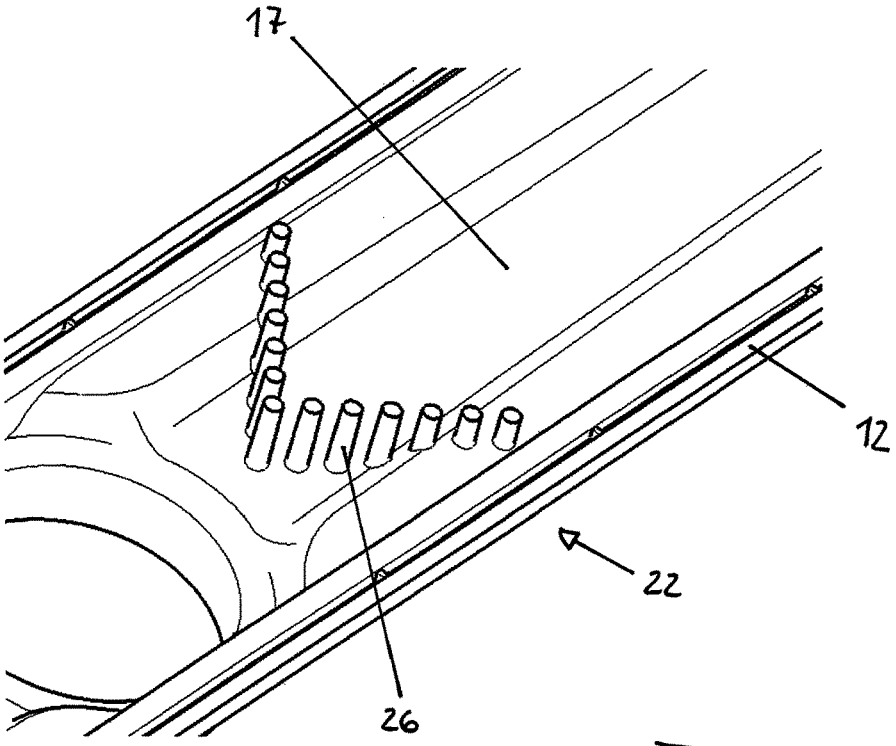
FIG. 2 illustrates a filter means provided in the spray arm of FIG. 1.

FIG. 1 further illustrates two embodiments for providing for filter means to prevent that larger dirt particles which have passed the filters provided in the sump of the washing compartment, reach any of the spray nozzles provided in the spray arm. A first filter means 22, which in further detail is shown in FIG. 2, is provided near the inlet 18 so as to filter the entire flow through feed channel 17. A second filter means 24 is provided in feed channel 16 so as to surround nozzle 20.

In the embodiment shown in the drawings which illustrate a plastic spray arm that is produced by injection molding, filter means 22 and 24 both comprise a plurality of posts 26 which are integrally formed in the lower member and/or the upper member so as to protrude from the lower member and the upper member in a substantially vertical direction.

When assembled, the posts 26 thus form a fence for retaining dirt particles that are larger than the gaps between posts 26. As shown in FIGS. 1 and 2, in embodiments where the filter means 22 spans substantially the entire cross-section of the feed channel 17, the filter means 22 preferably has an overall V-shape or convex shape which has two lateral side portions that are located at angles to the longitudinal direction of the feed channel 17, and a central portion protruding towards the upstream side of the filter means. In this manner, any dirt particles that are retained by the filter means will be flushed towards the side walls of the spray arm, whereas the central region of the flow channel 17 is kept unobstructed.

Figure 3:
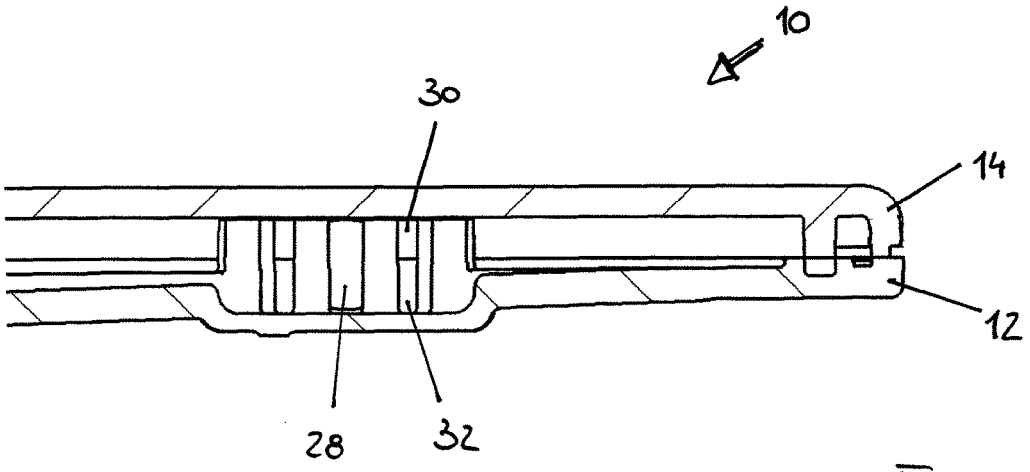
FIG. 3 is a sectional view of a first embodiment of a filter means provided in the spray arm of FIG. 1.

FIG. 3 is an enlarged view of filter means 24 which provides for a local protection of nozzle 20. The filter means 24 can be formed by a plurality of posts 28 that are provided at only one of the lower and upper members 12, 14 and which have a length to span the entire height of the feed channel 16 formed between the lower member 12 and the upper member 14.

Alternatively, filter means 24 can be formed by a plurality of posts 30, 32 that are provided at both the lower and the upper members 12, 14, wherein posts 30 provided at the lower member 12 are arranged to coincide with posts provided at the upper member 14, so that the combined lengths of posts 30 an 32 spans the height of the feed channel 16 between the lower member 12 and the upper member 14.

Figure 4:
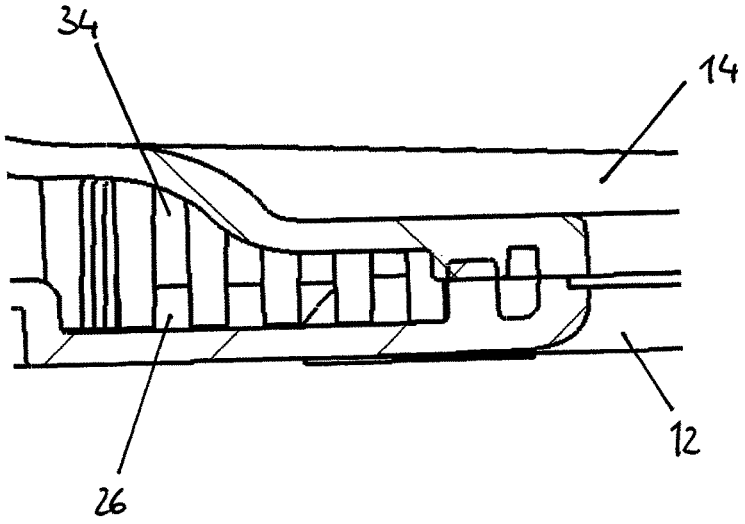
FIG. 4 is a sectional view of a second embodiment of a filter means provided in the spray arm of FIG. 1.

FIG. 4 is a view similar FIG. 3 of the filter means 22 which in the embodiment shown in FIG. 4 is formed of a first set of posts 26 formed integrally with the lower member 12 and a second set of posts 34 integrally formed at the upper member 14.

As will be understood from the above description, the spray arm suggested herein provides for a simple and easy to manufacture, but yet effective means to prevent larger dirt particles that have escaped any of the filters provided in the sump of the washing compartment, from reaching and thus blocking any of the nozzles provided in the spray arm.

Although not shown in the drawings, a similar effect can be achieved by providing for a filter means, such as a sieve element, which is installed at the inlet of the spray arm and which protrudes into the flow channels. Considering that such sieve element necessitates additional manufacturing steps for assembly with the spray arm, providing for integral filter means as shown in the drawings is preferred.

The invention claimed is:

1. A spray arm for a dishwasher, the spray arm comprising:

an inlet for a cleaning liquid, at least one spray nozzle and a feed channel for feeding the cleaning liquid from the inlet to the spray nozzle, and at least one filter located within the feed channel between the inlet and the spray nozzle, wherein the at least one filter comprises a filter spanning substantially an entire cross-section of the feed channel, and wherein the filter comprises two lateral sides within the feed channel that are located at angles to the longitudinal direction of the feed channel and a central portion within the feed channel protruding towards the upstream side of the filter.

2. The spray arm of claim 1, comprising a plurality of spray nozzles, wherein the at least one filter is provided in proximity of at least one of the spray nozzles.

3. The spray arm of claim 2, wherein each spray nozzle is provided with one or more of the at least one filter.

4. The spray arm of claim 1, wherein the at least one filter is located at an angle to the longitudinal direction of the feed channel.

5. The spray arm of claim 4, wherein the spray arm is a substantially flat elongate member, wherein the at least one filter is oriented substantially vertically.

6. The spray arm of claim 1, wherein at least the central portion of the filter is substantially V-shaped or convex.

7. The spray arm of claim 1, wherein the at least one filter comprises a grate, sieve or screen.

8. The spray arm of claim 1, wherein the filter comprises a plurality of flow orifices the size of which is smaller than the opening size of the at least one spray nozzle.

9. The spray arm of claim 1, wherein the filter comprises a plurality of flow orifices defining elongated slots.

10. The spray arm of claim 1, wherein the spray arm is a molded plastic part.

11. The spray arm of claim 1, wherein the filter is integrally formed with the spray arm.

12. The spray arm of claim 11, wherein the spray arm comprises a substantially flat lower member and a substantially flat upper member connected to the lower member so as to form the feed channel, wherein the filter comprises a plurality of posts protruding from at least one of the lower member or the upper member.

13. The spray arm of claim 12, wherein the lower member is connected to the upper member in an at least partially releasable manner.

14. The spray arm of claim 1, wherein the filter comprises a filter insert mounted at the inlet and protruding into the flow channel.

15. The spray arm of claim 1, wherein each of the lateral side portions is linear.

16. The spray arm of claim 1, wherein the spray arm is configured to be rotated about a central axis.

17. A spray arm for a dishwasher, the spray arm comprising:

an inlet for a cleaning liquid, at least one spray nozzle and a feed channel for feeding the cleaning liquid from the inlet to the spray nozzle, and a filter located within the feed channel between the inlet and the spray nozzle, the filter extending substantially across the feed channel relative to a longitudinal direction of the spray arm, wherein the filter comprises a plurality of posts extending from a surface of the spray arm into the feed channel.

18. The spray arm of claim 17, wherein each of the plurality of posts extend perpendicular to a longitudinal direction of the feed channel and perpendicular to a flow direction in the feed channel.

19. The spray arm of claim 17, wherein each of the plurality of posts extends parallel to the remaining posts of the plurality of posts.

20. The spray arm of claim 17, wherein the spray arm comprises a substantially flat lower member and a substantially flat upper member connected to the lower member so as to form the feed channel, wherein the plurality of posts protrude from at least one of the lower member or the upper member.

21. The spray arm of claim 20, wherein the lower member is connected to the upper member in an at least partially releasable manner.

* * * * *